United States Patent [19]

Lovely et al.

[11] 4,058,934

[45] Nov. 22, 1977

[54] INTERFORM GRINDING MACHINE

[75] Inventors: John W. Lovely; Robert N. Hobbs, both of Springfield, Vt.

[73] Assignee: Bryant Grinder Corporation, Springfield, Vt.

[21] Appl. No.: 750,660

[22] Filed: Dec. 15, 1976

Related U.S. Application Data

[62] Division of Ser. No. 645,257, Dec. 29, 1975, Pat. No. 4,023,310.

[51] Int. Cl.[2] ..... B24B 53/04

[52] U.S. Cl. ..... 51/5 D; 51/165.88; 125/11 BS; 125/11 AS; 125/11 ST

[58] Field of Search ..... 51/165.87, 165.88, 5 D, 51/85 R, 124 R, 32; 125/11 A, 11 BS, 11 DG, 11 AS, 11 H, 11 ST

[56] References Cited

U.S. PATENT DOCUMENTS

| | | | |
|---|---|---|---|
| 1,549,600 | 8/1925 | Mueller | 51/165.87 X |
| 2,146,466 | 2/1939 | Dannecker | 125/11 A |
| 2,388,067 | 10/1945 | Markus | 51/165.87 X |
| 2,409,240 | 10/1946 | Barker | 125/11 AS |
| 2,602,439 | 7/1952 | Muench | 125/11 A |
| 2,652,663 | 9/1953 | Taylor | 51/165.88 |
| 2,792,823 | 5/1957 | Muench | 125/11 A |
| 3,782,046 | 1/1974 | Schaap | 51/165.87 X |

OTHER PUBLICATIONS

"Little Wonder Radius Dresser," George Scherr Co., Inc., New York, N. Y. 6/1943.

*Primary Examiner*—Gary L. Smith
*Attorney, Agent, or Firm*—Krass & Young

[57] ABSTRACT

A grinding machine having a fixed wheelhead and a biaxially movable workslide. The workslide is mounted on a cylindrical slidebar for axial sliding motion as well as pivotal motion around the bar. A dresser assembly is also mounted pivotally on the slidebar for selective dressing operations. The workslide may be moved axially into an overlapping relationship with the dresser such that the workslide is carried with the dresser over a range of pivotal displacement thereof. An hydraulic cylinder is used to pivot the dresser and a precisely positionable stop is used to control all lateral feed motions. Axial speed is programmed by a control valve. The dresser is pivotal on its base to produce a true circle wheel profile.

1 Claim, 22 Drawing Figures

INTERFORM GRINDING MACHINE

This is a division of application Ser. No. 645,257, filed Dec. 29, 1975, now U.S. Pat. No. 4,023,310, issued May 17, 1977.

INTRODUCTION

This invention relates to improvements in grinding machines of the type employed for long work runs of a high repetitive nature wherein work feed and wheel dress operations are carried out substantially automatically.

BACKGROUND OF THE INVENTION

Industrial grinding machines of the type used to finish bearing races, valve lifter bodies, and other such mass-produced components are typically highly automated and must perform such operations as feed and wheel dress in a repetitive and precise fashion. Satisfactory precision and economy are difficult to achieve within the framework of prior art systems such as those involving slides or ways, and screw shafts or similar devices on crossing axes to effect both longitudinal and lateral feed. A radically different and much more workable approach to accomplishing feed is to mount either the wheelhead or the workhead on a slidebar which permits not only longitudinal displacement between the work and the wheel but pivotal displacement of one of the assemblies about the slidebar to effect a lateral feed motion. In this case, the lateral feed motion is not linearly but rather is along an arc related to the radial distance of the wheelhead center from the slidebar center. Such implementation is disclosed in the copending application for U.S. Pat. Ser. No. 464,917, filed Apr. 29, 1974, in the name of Hugh T. Edgar et al, now U.S. Pat. No. 3,932,960, issued Jan. 20, 1976. This invention also employs a slidebar and assemblies mounted thereon for both longitudinal and pivotal motion to produce a feed motion between work and wheel in a precise, repeatable fashion.

The dress operation must also be carried out with precision since dressing the wheel generally involves reducing the size thereof. Moreover, it is necessary to correlate the size reduction with the grind/feed operation to compensate for the change in wheel size. In prior art machines, the separate and independent control of dress and feed operations tends to compound the opportunity for mechanical position error; i.e., position erros due to metal compliance, play between contacting surfaces, and so forth.

BRIEF DESCRIPTION OF THE INVENTION

The principal object of the present invention is to provide a grinding machine of improved accuracy and simplified design which, in the preferred embodiment, is capable of performing both grinding and dressing operations and in which sources of mechanical position error are minimized. In general, this is accomplished in a grinding machine having a base, a slidebar mounted on the base, a wheelhead fixed to the base and both workslide and dresser assemblies mounted on the slidebar for displacement relative to the wheelhead and relative to one another.

In the preferred embodiment the workslide is longitudinally movable as well as rotatable about the bar for feed operations and the dresser assembly is rotatable about the slidebar in the plane of the wheel for dressing operations. Moreover, rotational displacements of both the dresser assembly and the workslide are provided by a single power source such as an hydraulic cylinder connected permanently to the dresser base thus minimizing components and potential error sources. This is accomplished by providing workhead and dresser assembly extensions, hereinafter called "tails," which may be placed into overlapping or interfering relationship by longitudinal displacement of the workslide into the grind position such that the dresser base, when rotated about the slidebar, carries the workslide therewith to feed the part into the wheel.

Another feature of the invention is the provision of a grind stop abutment on the dresser base to positively limit the longitudinal (axial) displacement of the workslide into the grind position. This abutment, the wheel, the dresser head center, the gagehead and the center line of the feed are all disposed in a common plane thus eliminating sources of mechanical position error.

Another feature of the invention is the provision of a dresser assembly including a base which is rotatably disposed on a slidebar and which carries both a dresser implement and a gagehead which is adapted to provide in-process gaging operations. Thus, when the workslide tail is interposed between the dresser tail and feed screw, and the dresser base is lifted to the point where it lifts the workslide, the two units move as one ensuring that the gage on the dresser base is properly oriented with respect to the work for accurate gaging.

Another feature of the invention is the provision of a part loading magazine as well as an unload apparatus such as a turn table which is carried with the workslide thus to permit part loading and unloading operations at any selected longitudinal workslide position.

Another feature of the invention is the provision of a power means for effecting longitudinal displacement of the workslide relative to the wheelhead and means for programming the displacement speed of the workslide over the path of movement thereof. More specifically, it is desirable to program a rapid speed increase from dead stop to mid-travel and a speed decrease as the workslide approaches the opposite extreme of movement. In general, this is accomplished by providing a variable valving arrangement which controls the flow of fluid such as oil to an hydraulic cylinder, a slide operatively connected to the valve spool and moved in opposite directions by workslide stops, the slide being spring-centered at the maximum speed position and moved in the opposite directions therefrom by displacement of the workslide.

Another feature of the invention is the provision of a dresser base having a separately adjustably mounted dresser housing thus to permit the dresser housing to be laterally adjusted in position to accommodate different wheel sizes.

Another feature of the invention is the provision of a lateral feed control means wherein a relatively non-precision power means is actuated to move the workslide and the dresser base about the slidebar to an extent determined by the position of a precisely controlled mechanical stop. Accordingly, the precision part of the feed system does not carry the loads imposed by the grinding or dressing operations but merely positions the feed limit stop.

Still further features of the invention include a wheelhead drive belt tension regulator and a dresser apparatus capable of producing a true circle dress operation on the periphery of a wheel as well as many other features and advantages hereinafter described. These features and advantages will be best understood from a reading of the following specification which is to be taken with the accompanying drawings.

DETAILED DESCRIPTION OF THE SPECIFIC EMBODIMENT

I. GENERAL ASSEMBLY

Figure 1:
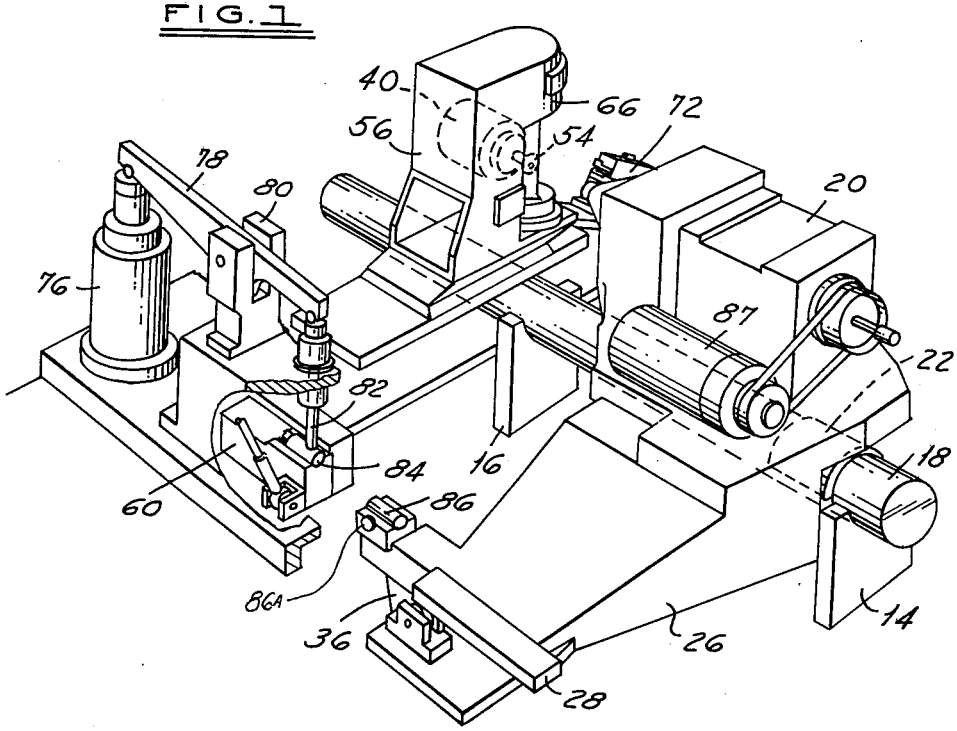
FIG. 1 is a perspective drawing of a representative portion of a grinder embodying the invention with the dresser assembly disposed in the wheel dress position.
Figure 2:
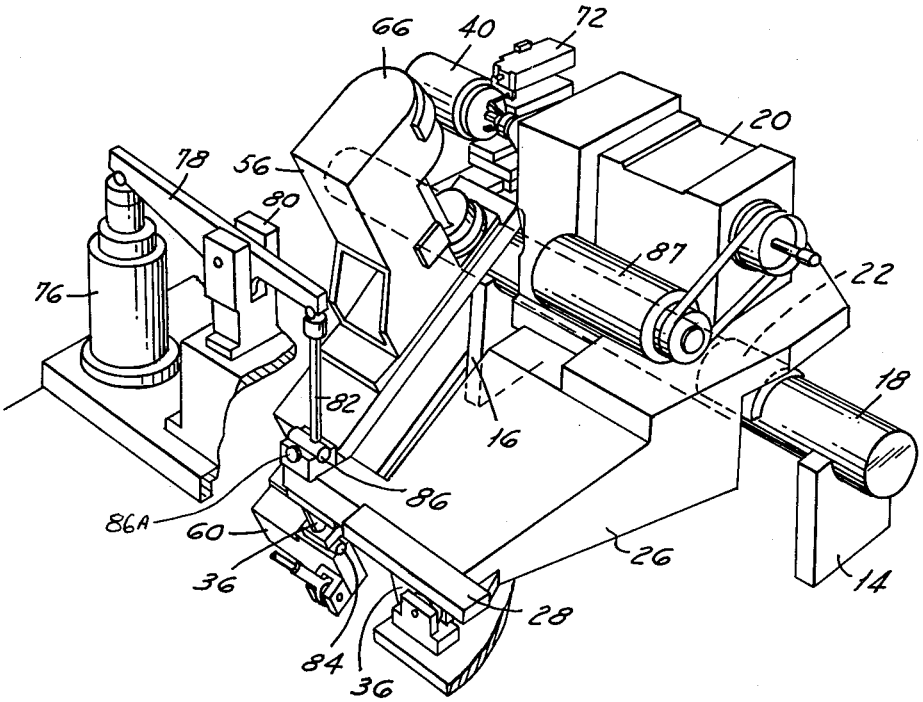
FIG. 2 is a duplicate of the apparatus of FIG. 1 with the dresser assembly and the workslide assembly in a grind position.
Figure 3:
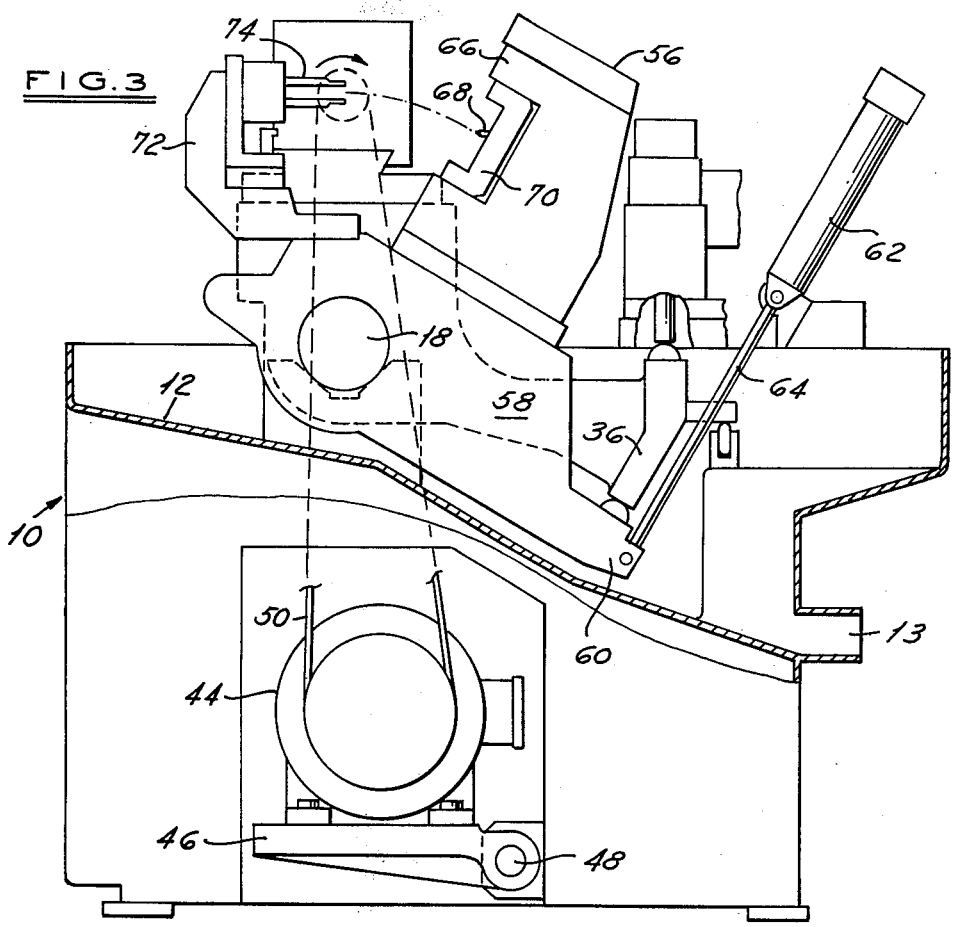
FIG. 3 is an end view of a grinding machine embodying the invention with the apparatus in the gaging/-grinding position.
Figure 4:
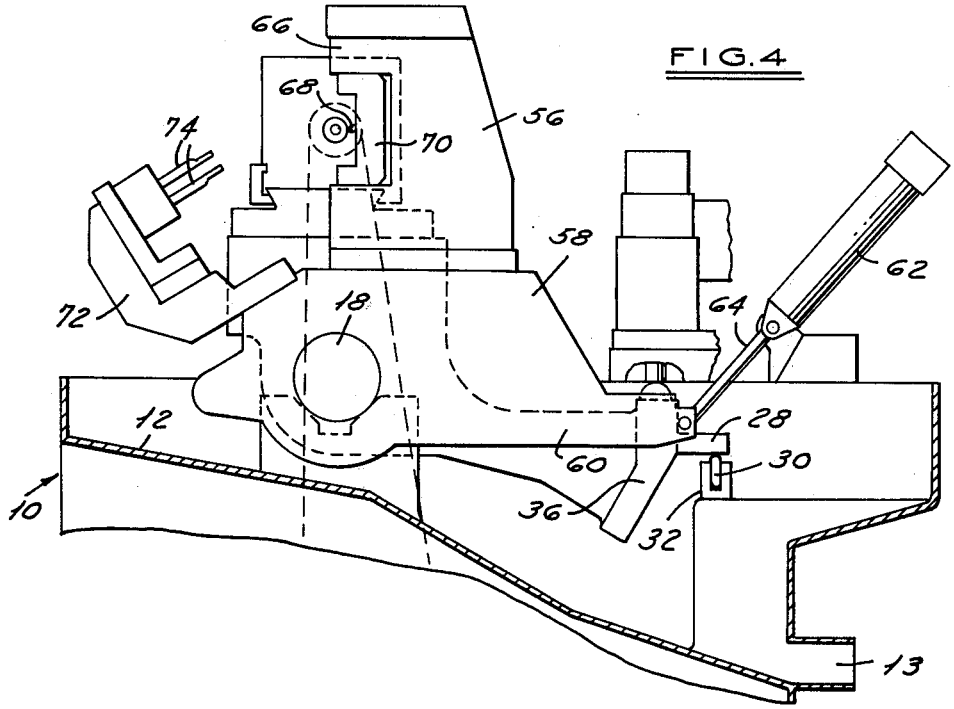
FIG. 4 is another end view of the apparatus of FIG. 3 but in a dress position.

Referring now to the drawings and particularly to FIGS. 1 through 8, a general description of the major operating components of a plunge grinder embodying the invention will be made. The grinder comprises a large rigid base 10 adapted to rest on a factory floor and having an integral coolant catch pan 12 as best shown in FIGS. 3 and 4. The coolant catch pan is inclined downwardly to an exit point 13 where coolant can be collected and cleaned for recirculation. Base 10 carries a plurality of spaced slidebar support members 14 and 16 which in turn carry in fixed relation therewith a cylindrical slidebar 18.

The first principal operating unit mounted on the slidebar is the workslide assembly 20, the base of which is mounted on half round pressure-lubricated, cast iron bearings 22 and 24 which in turn rest on the upper surface of slidebar 18. Bearings 22 and 24 permit the workslide 20 to rotate about the axis of slidebar 18 and to move axially along slidebar 18 as hereinafter described.

Workslide 20 is a large, rigid weldment, the major work carrying components of which are disposed substantially vertically above the longitudinal axis of slidebar 18. These components comprise a workpiece loading arrangement, a workholder or chuck, as hereinafter described, and a work drive motor 87 which turns the workpiece during the grind operation. Workslide 20 further comprises a tail 26 which extends laterally away from the slidebar 18 having a plate 28 welded thereto at the outer extremity and normally resting on a tail bearing roller 30 rotatably disposed in a bracket 32. The bracket is mounted on surface 34 of base 10. Plate 28 is longitudinally oriented as shown in FIGS. 2 and 3 to provide a third support point for the workslide 20 while at the same time accommodating longitudinal displacement of the workslide 20 along the axis of slidebar 18. Tail 26 further comprises an angularly depending ski 36 which, under conditions hereinafter described, represents a workslide lift point to provide lateral feed of the workslide assembly relative to the grinding wheel 54. The longitudinal position of the workslide 20 relative to the wheel 54 is controlled by a double-acting workslide cylinder 38 mounted on base 10 and operable to feed the work to and from the grinding wheel 54.

Figure 5:
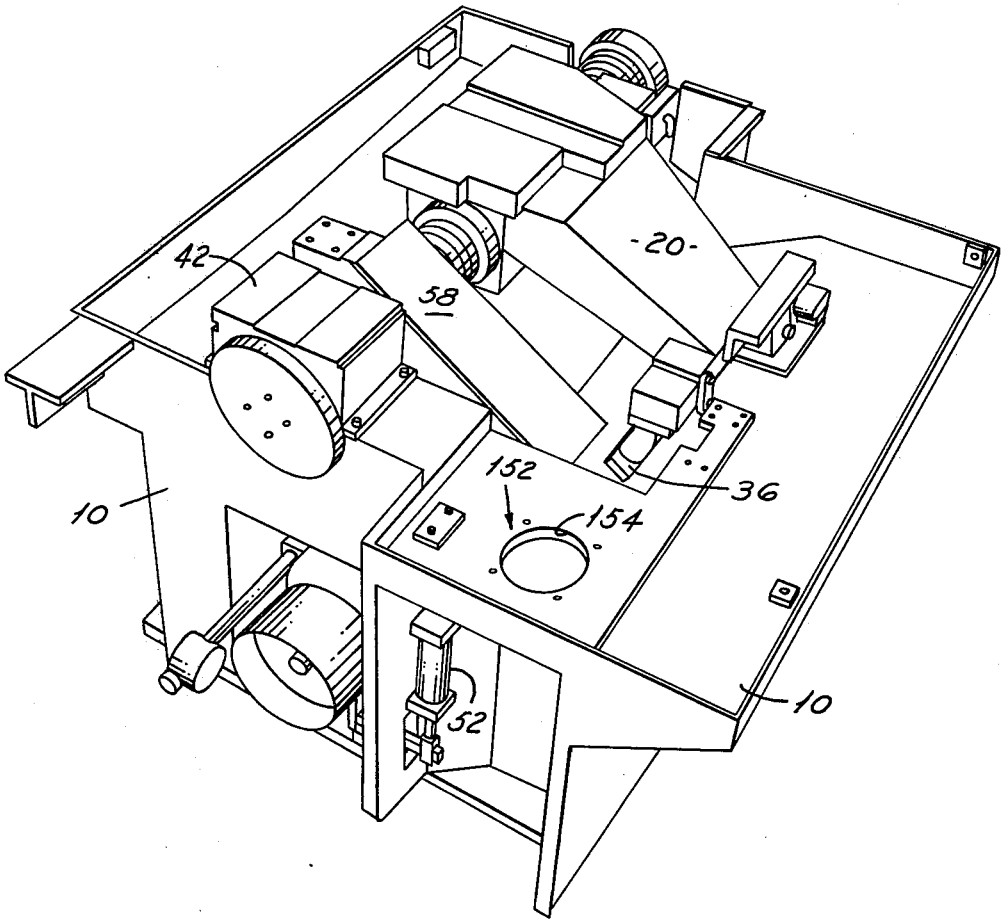
FIG. 5 is a perspective drawing of a partially assembled grinder embodying the invention showing the wheelhead and the workslide and dresser bases mounted on the slidebar.
Figure 6:
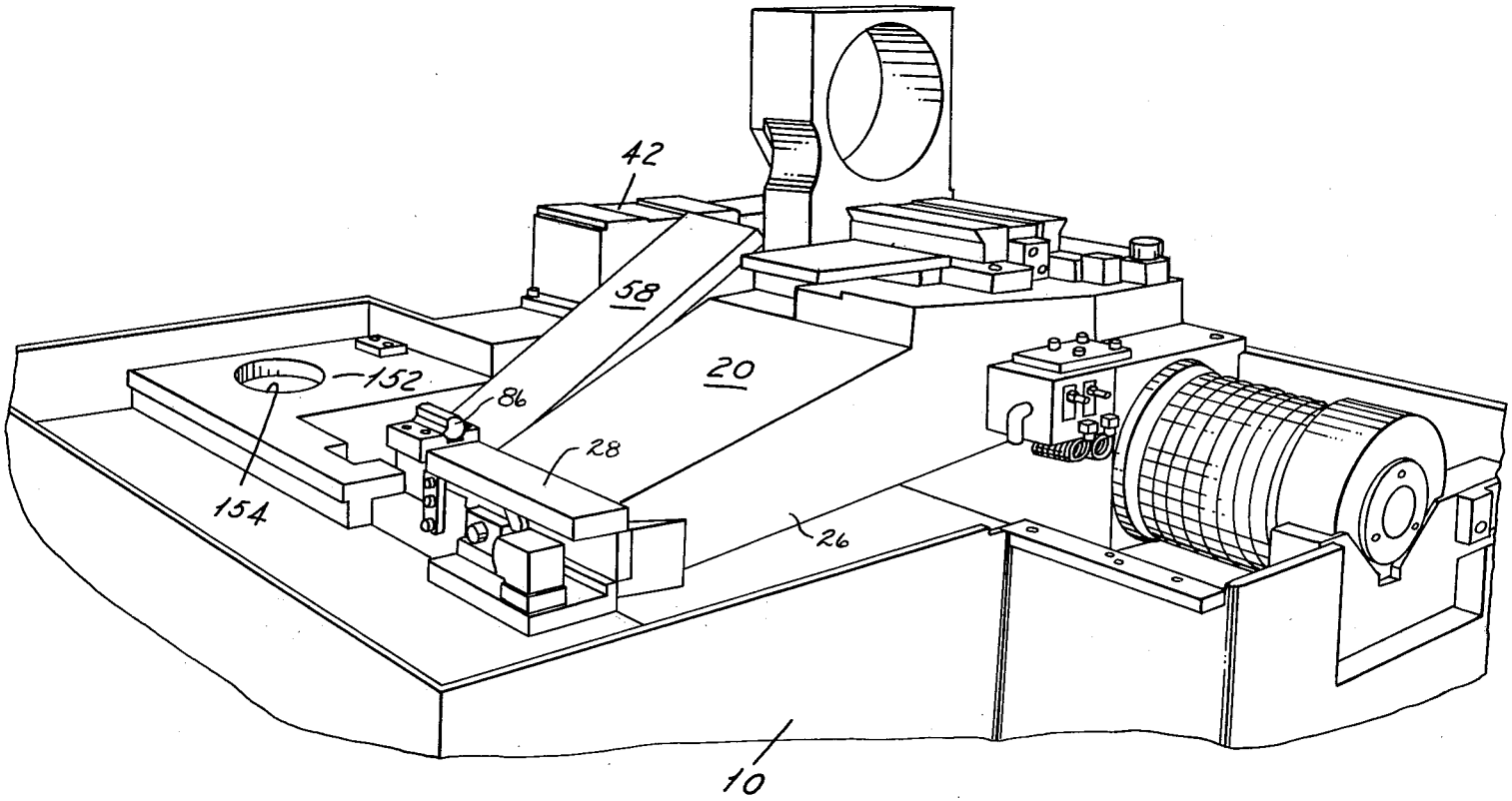
FIG. 6 is another perspective drawing of a partially assembled grinder embodying the invention emphasizing the support of the workslide tail.
Figure 7:
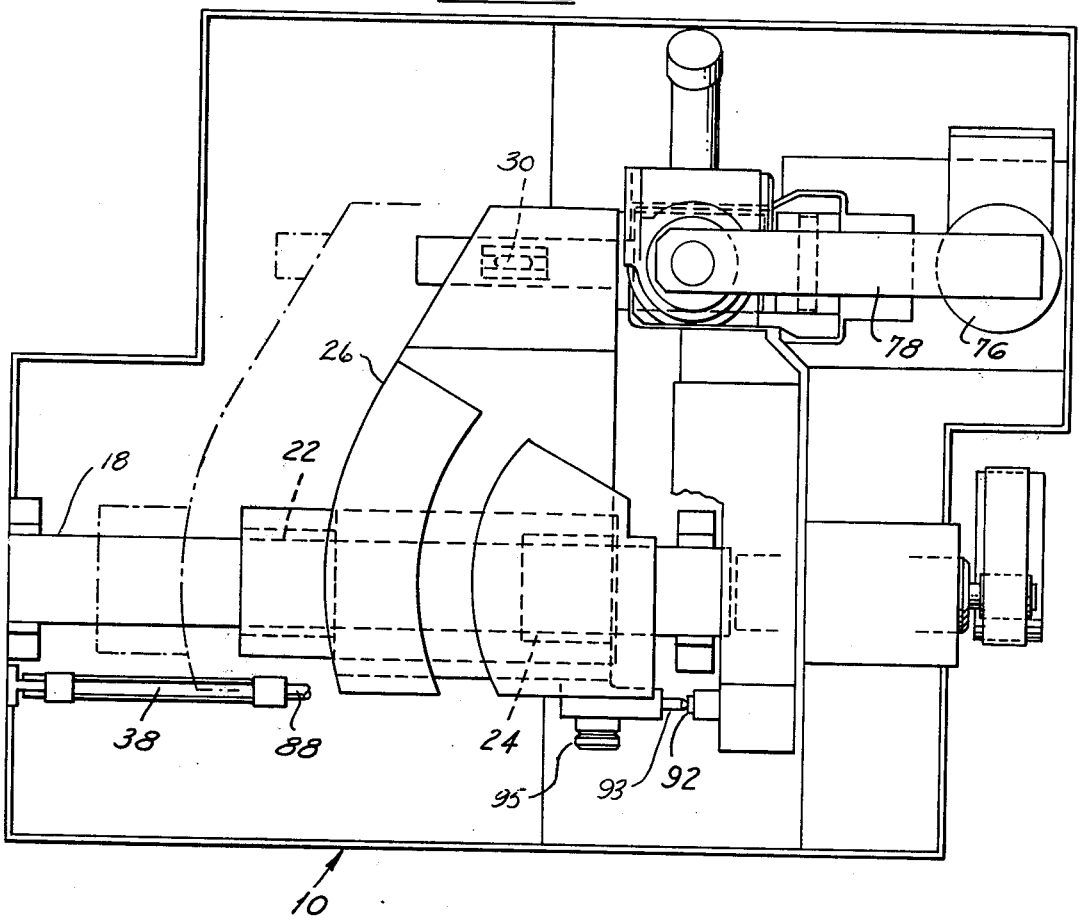
FIG. 7 is a plan view of a grinder embodying the invention.

The illustrated grinding machine further comprises a wheelhead 40 which is fixed to a wheelhead support bridge 42 mounted on the base 10 directly over the slidebar 18 as best shown in FIG. 5. The wheelhead 40 is near the end of slidebar 18 opposite the workslide 20, a dresser assembly 56 being disposed between the wheelhead and the workslide as hereinafter described.

Wheelhead 40 is driven by a wheelhead drive motor 44 mounted in the lower part of the base 10 as best shown in FIG. 3. The mounting arrangement comprises a drive motor support plate 46 which is connected to the base 10 by means of a heavy duty pivot 48 such that the mass of motor 44 applies tension to the vertically oriented drive belt 50. Belt tension is controlled by a tension control cylinder 52 mounted on base 10 and operable to oppose the gravitational force of motor 44 about pivot 48 to maintain a predetermined belt tension. Wheelhead 40 carries a grinding wheel 54 which, in this case, is an abrasive wheel having a circular peripheral working surface adapted to finish a bearing race in a plunge grinding operation.

The second principal operating unit disposed on slidebar 18 is the dresser assembly 56. This assembly comprises a welded dresser base 58 rotatably mounted on slidebar 18 by way of two axially spaced tapered roller bearings 19. Assembly 56 comprises a dresser base tail 60 extending laterally therefrom and on the same side of slidebar 18 as the tail 26 of work slide 20. A feed cylinder 62 pivotally mounted on base 10 comprises a connecting rod 64 pivotally connected to the lateral extremity of dresser base tail 60 to control the angular displacement of the dresser assembly 56 about the slidebar 18. Dresser base 58 carries a dresser housing 66 including a diamond 68 mounted in pivotal holder 70 in the plane of the grinding wheel 54. Rotation of assembly 56 about slidebar 18 moves the diamond 68 toward and away from the grinding wheel 54 for wheel dress purposes. Holder 70 is rotatable relative to housing 66 about a substantially vertical axis to maintain the circular peripheral working surface of wheel 56 as hereinafter described.

As best shown in FIGS. 3 and 4, the dresser housing 66 is disposed on base 58 over the slidebar 18 and laterally offset in the direction of the tail 60. Also mounted on the base 58 but opposite the housing 66 is a gage head 72 having laterally projecting gage fingers 74 for providing an in-process gaging operation as described. Gage fingers 74, as hereinafter described, contact the work surface during the grinding operation to control grind as a function of measured work dimension. A gage device having fingers of the type shown at 74 and suitable for use with the subject invention is available from E. W. Hager Co. of Colts Neck, New Jersey.

The angular position of the dresser assembly 56 as well as the angular feed position of workslide 20 is controlled by a feedcase 76 mounted on base 10. Feedcase 76 comprises an output member which is connected by way of a lever arm 78 mounted in fulcrum bracket 80 to a feed contact piston 82. Piston 82 depends through a support structure hereinafter described toward a dresser tail contact roll 84 fixedly disposed on the tail 60 such that angular rotation of the dresser assembly about slidebar 18, in the counterclockwise direction as viewed in FIG. 3, is limited by the position of piston 82. This position in turn is controlled by the position of the feed screw within feed case 76. As will hereinafter become more apparent, angular displacement of the dresser assembly as well as lateral feed of the work to the wheel 54 is effected by providing power from cylinder 62 which runs the positionable assemblies 20 and 56 against the end piston 82, the position of which may be precisely controlled. Therefore, the feedcase 76 is not required to furnish the power to move the part into the wheel during the actual grind operation. This separation of functions provides more accurate feed operations for both dress and grind steps.

Dresser tail 60 is provided with a contact roll 84 which contacts the end of piston 82 during controlled rotation of assembly 56 as shown in FIG. 1. Workslide tail 26 is provided with contact roll 86 above ski 36 to control piston 82 during the grind operation. To achieve contact between roll 86 and piston 82, the workslide 20 must be displaced longitudinally by cylinder 38 until tail 26 overlaps the dresser base tail 60 and ski 36 rests on roll 84. The overlapped condition is best shown in FIG. 2. From the foregoing, it can be seen that when tail 26 of workslide 20 overlaps tail 60 of dresser base 58, operation of the feed cylinder 62 in such a direction as to lift the tail 60 of the dresser assembly also lifts the tail 26 of the workslide causing the work to be fed laterally into the grinding wheel 54. The degree of lateral feed is controlled by the position of feed contact piston 82.

Briefly describing a typical operation of the apparatus set forth thus far, the work is loaded into the workslide 20 so as to be positioned for longitudinal feed into the grinding wheel 54. A magazine type loading apparatus and a magnetic chuck is preferred as hereinafter described. Workhead motor 87 is started to rotate the workpiece in the chuck during the grinding operation. Similarly, motor 44 is started to rotate the grinding wheel 54 by way of the wheelhead 40. The initial position of the workslide 20 is as represented in FIG. 1; i.e., axially spaced from the dresser assembly 56.

Assuming wheel 54 requires dressing, feedcase 76 is operated by means of an appropriate input system for determining the dress feed end point thereby to properly position feed contact piston 82. Feed cylinder 62 is operated to raise the tail 60 of the dresser assembly 56 until the diamond 68 engages the periphery of the grinding wheel 54. The dresser holder 70 is rotated in a true circle arc to establish the desired circular periphery on the grinding wheel 54. Feed cylinder 62 is thereafter operated in the opposite direction to lower the tail 60 of dresser assembly 54 back to the position shown in FIG. 3.

At this time, the workslide cylinder 38 is operated to longitudinally displace workslide 20 toward dresser assembly 56 until the depending ski 36 is substantially over the roll 84 on the dresser assembly tail 60. Feedcase 76 is again operated by suitable end point programming to reposition feed contact piston 82. Feed cylinder 62 is operated to lift tail 60 until the clearances between roll 84 and ski 36, and between roll 86 and feed contact cylinder 82 are taken up. Lifting tail 26 further feeds the work into the wheel 54. Where the in-process gage head 72 is employed, lifting roll 84 into contact with ski 36 places fingers 74 in contact with the part so as to monitor the grind operation on a dimensional basis.

After the grind, feed cylinder 62 is operated in the reverse direction to lower the tail 26 until the plate 28 rests on roller 30. Workslide cylinder 38 is operated in the reverse direction to back the work off of the wheel 54 and the workpiece is unloaded. The overall cycle repeats for as many parts as are required in the current run or until a new wheel 54 must be installed.

II. WORKSLIDE POSITIONING

Referring to FIGS. 7 and 9 through 16, the mechanism for precisely controlling the longitudinal displacements of the workslide 20 will be described.

Figure 11:
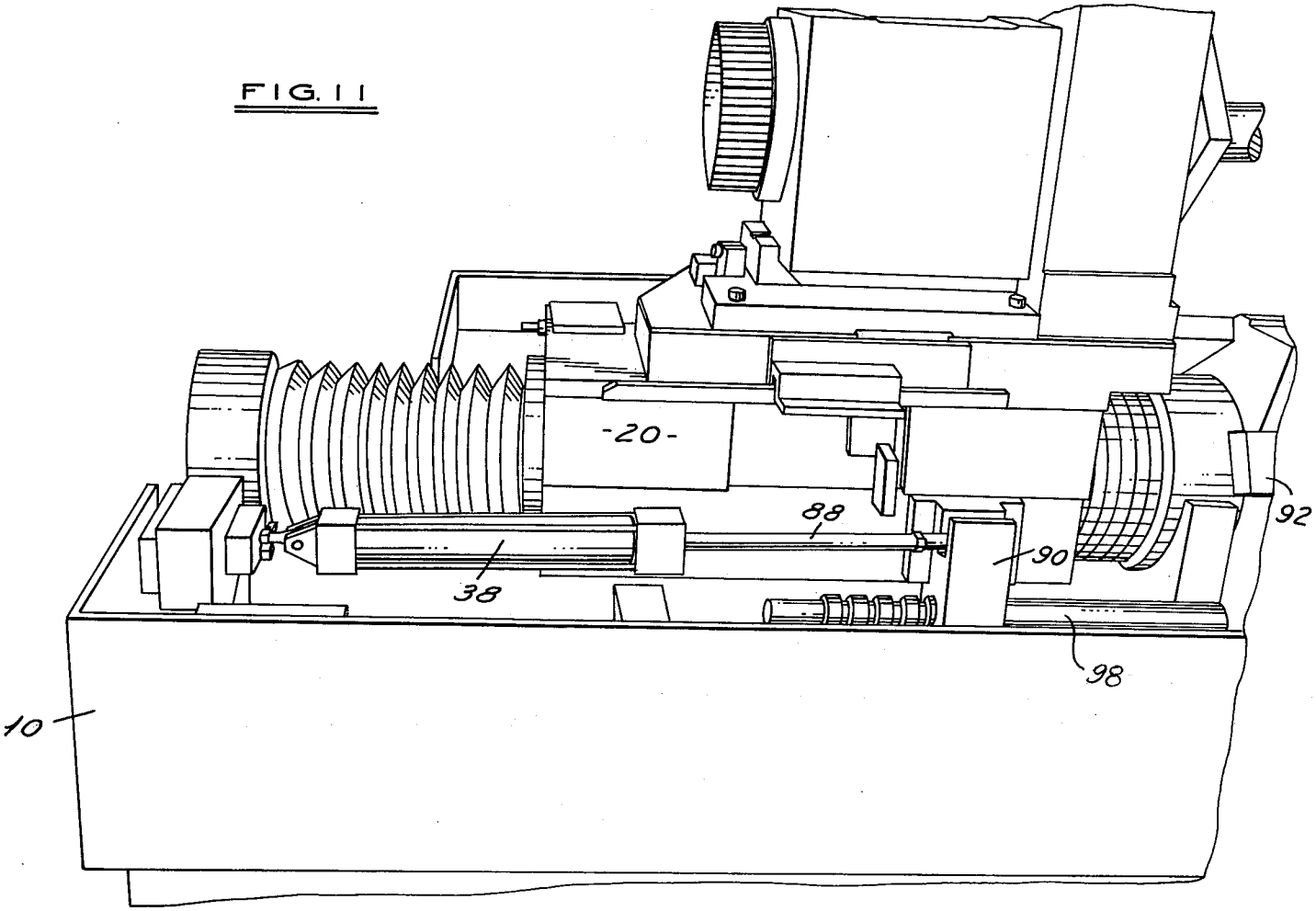
FIG. 11 is a detailed front view of the longitudinal feed control system for the grinder of FIGS. 1 through 6.

In general, the workslide assembly 20 is moved longitudinally along the slidebar 18 by the double-acting oil cylinder 38. As best shown in FIG. 11, cylinder 38 is anchored on the left end to the machine base 10. The extensible ouput rod 88 of cylinder 38 is connected to a bracket 90 which is mounted on the side of the workslide assembly 20 opposite the tail 26. Forward travel of the workslide assembly 20, i.e., travel toward the wheelhead 40, is mechanically limited by a grind stop abutment 92 (FIG. 7) which is fixed on the dresser bar 58 in such a position as to positively interfere with the further forward motion of the workslide 20. An important aspect of the grinder lies in the fact that the grind stop abutment 92, the center plane of the grinding wheel 54, the center of the diamond dresser 68, the center of the feed contact piston 82 and the working edge of the in-process gage fingers 74 all lie in precisely a vertical plane which is perpendicular to the longitudinal axis of the slidebar 18. The forward displacement limit of the workslide 20 is set by adjustment of pin 93 which contacts abutment 92 at the limit of travel. The position of pin 93 is set by knob 95 in a conventional manner. If, for example, a ball track is being ground, pin 93 is set to position the workslide 20 at the limit of travel such that the center of the ball track is in the plane of the center of curvature of the grinding wheel.

Figure 9:
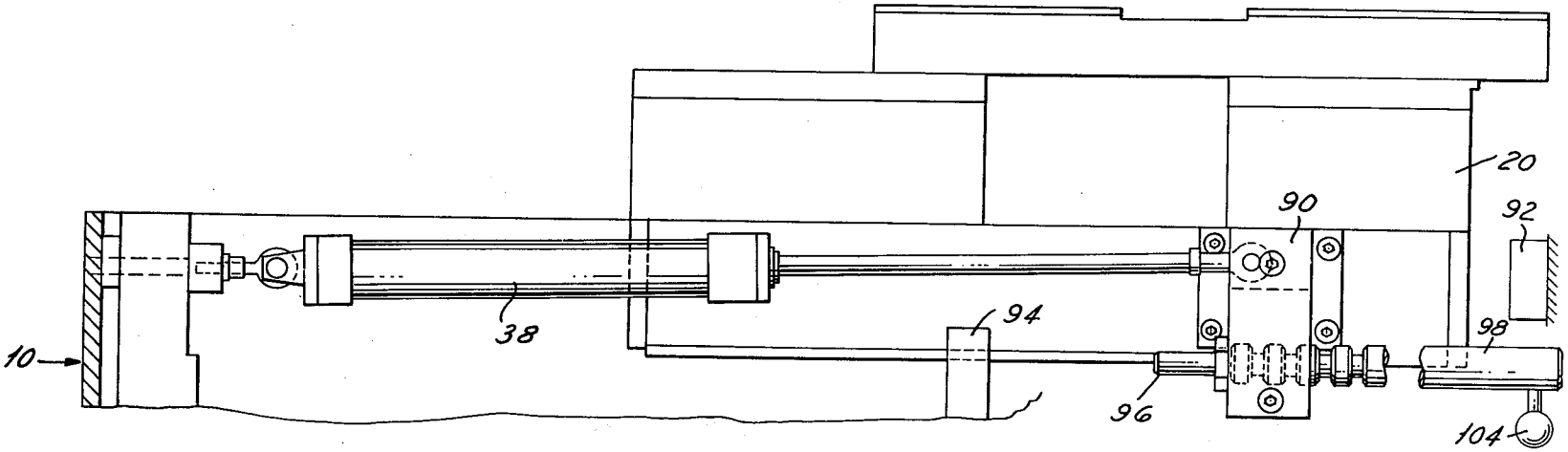
FIG. 9 is a front view of the workslide longitudinal positioning system.
Figure 10:
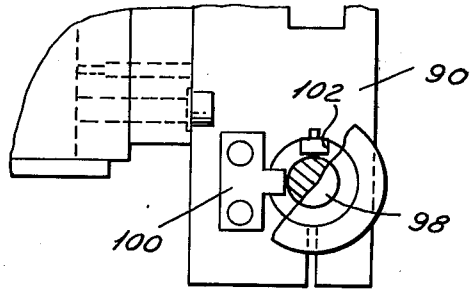
FIG. 10 is a detail of the system of FIG. 9.

Travel of workslide 20 in the rearward direction, i.e., away from the wheelhead 40, is also mechanically limited by the interfering contact between a rear stop 94 mounted on the base 10 and the end 96 of an adjustable stop shaft 98 which is carried by the workslide 20. Shaft 98 is supported by the lower end of bracket 90. The left end of shaft 98 is machined as shown in FIG. 9 to provide a series of four lengths of reduced diameter spaced apart from one another by 1 inch increments. In addition, the shaft is notched out to provide a keyway 102 shown in FIG. 10 which cooperates with a key 100 mounted on bracket 90 adjacent the shaft 98 to permit the shaft to be turned to the position wherein the key 100 and the keyway 102 line up, adjusted in longitudinal position and rotated 90° as shown in FIG. 10 to latch or lock in the newly selected position. A handle 104 is provided on the shaft 98 for adjustment purposes.

It has been found desirable to program the speed of the workslide 20 so as to avoid running against either of the stops 92 or 94 at full speed. In general, this is accomplished by controlling the flow of oil from a pressure source to the cylinder 38 in accordance with the actual position of the workslide 20 so as to effect a reduced oil flow as the workslide approaches the mechanical stops.

Figure 13:
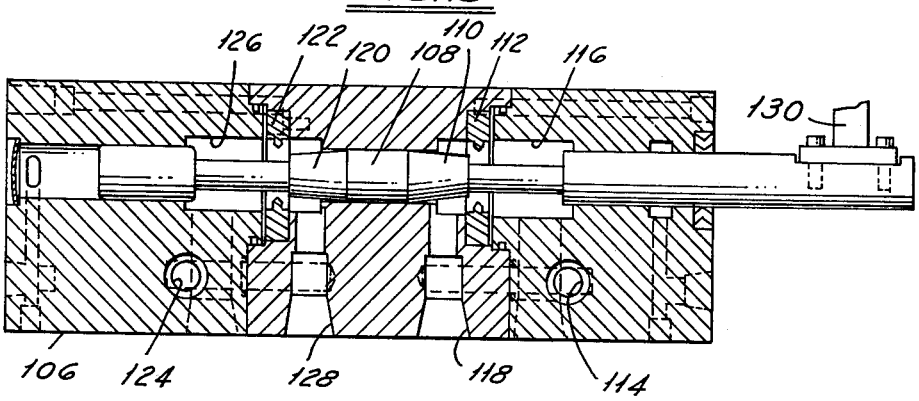
FIG. 13 is a sectional view of a spool valve in the longitudinal feed speed control system.
Figure 12:
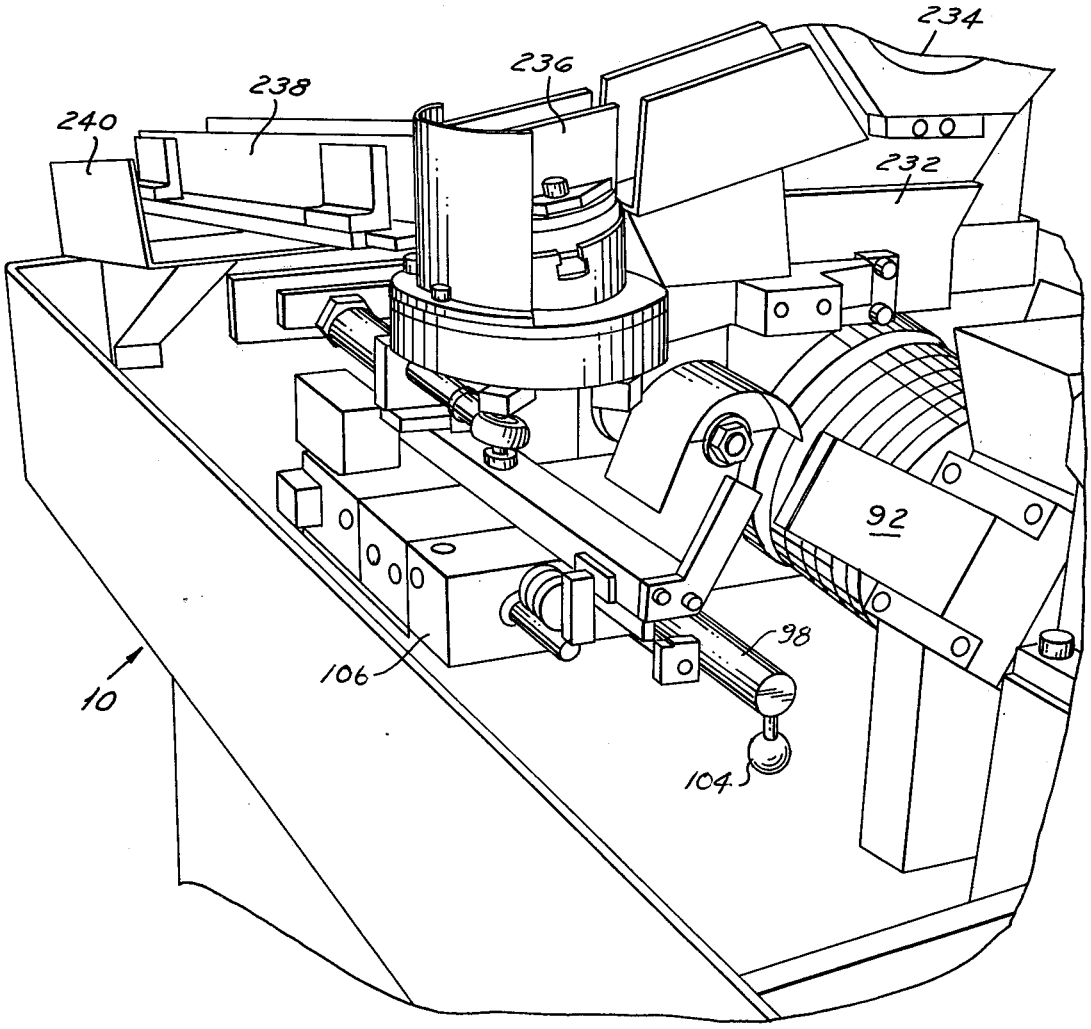
FIG. 12 is a perspective view of the base, grind stop abutment, and longitudinal displacement speed control.

Looking to FIGS. 12 and 13, the deceleration valve 106 is shown to comprise a longitudinally slidable spool 108 having a righthand tapered portion 110 adjacent and displacable through an orifice plate 112 having an internal knife-edge periphery to regulate the flow of oil from a high pressure source to the righthand displacement inlet of cylinder 38 by way of port 114, chamber 116 and outlet port 118. It can be seen that as the spool 108 is shifted to the right as viewed in FIG. 12 the flow of oil from port 114 to 118 is reduced in proporation to the degree by which the tapered spool portion 110 enters the knife-edge periphery of orifice plate 112. The use of an orifice plate and tapered valve spool eliminates the sensitivity of the deceleration valve mechanism to changes in oil viscosity which, of course, is a function of temperature.

A programmed speed curve of the workslide movement from the grind stop abutment 92 to the rear stop 94 is also provided by deceleration valve 106 which is generally reversely symmetrical about the centerline of the drawing of FIG. 12. More specifically, a valve spool 108 is provided with a second tapered length 120 cooperable with a second orifice plate 122 to regulate the flow of oil from a high pressure source through inlet port 124, chamber 126 and outlet port 128. The outlet port 128 is connected to the cylinder 38 in such a fashion as to produce leftward movement as viewed in FIGS. 11 and 12 of the workslide 20.

Figure 14:
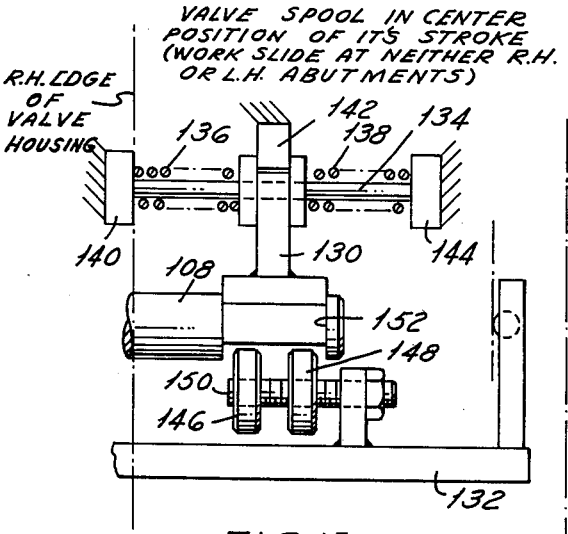
FIGS. 14 through 16 are diagrammatic views of the speed control system for various operating positions.
Figure 15:
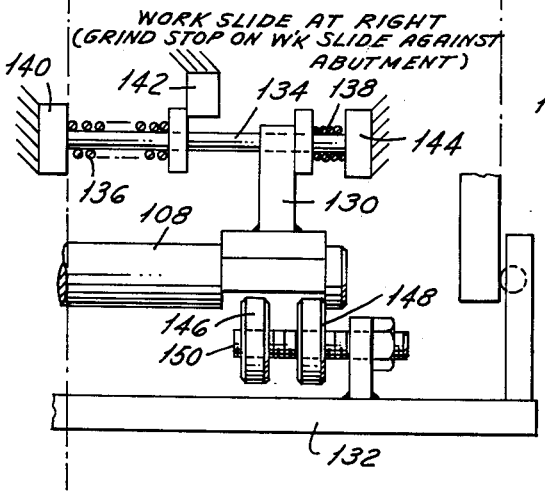

Valve spool 108 of deceleration valve 106 must, of course, be shifted to the right and left along with the workslide 20 in order to provide the deceleration function previously described. This is accomplished by means of a lost motion connection between a laterally projecting arm 130 on the shaft of the valve spool 108 and a slide 132 which is carried to the right and left by corresponding displacements of the workslide assembly 20. The spool 108 is also biased toward the centered position shown in FIG. 12 by means of a spring-centered slide mechanism 134 shown in FIGS. 14 through 16. FIG. 14 shows the spool 108 in the centered position wherein arm 130 is held by equal and opposite forces generated by springs 136 and 138 trapped between stops 140, 142 and 144 mounted on the housing 106. In this position, maximum oil flow passes through the deceleration valve 106 in either the right or lefthand direction causing maximum speed displacement of the workslide 20 in the selected direction. Slide 132 which moves with the workslide 20 carries two knurled stops 146 and 148 adjustably disposed on a threaded shaft 150 and cooperable with a notched portion 152 of the valve spool shaft 108 to provide a lost motion interfering fit therewith. As shown in FIG. 14 with the valve spool 108 in the center position and workslide assembly 20 substantially centered between the righthand and lefthand abutments 92 and 94, respectively, the stops 146 and 148 do not contact either end of the notched portion 152 of the spool 108. However, as the workslide assembly 20 reaches the righthand or grind stop abutment, slide 132 is caused to be displaced to the right such that stop 148 engages the righthand shoulder of valve spool 108 carrying the valve spool to the right and effecting the reduced oil flow previously described. This displacement causes arm 130 to compress spring 138 against stop 144 creating a bias tending to return the spool 108 to the central position. FIG. 15 illustrates the result of workslide displacement to the lefthand stop 94. Under these circumstances, stop 146 on shaft 150 engages the lefthand shoulder on valve spool 108 carrying the valve spool to the left and reducing the flow of oil from the high pressure source to the workslide cylinder 38 as previously described. Arm 130 on valve spool 108 compresses spring 136 against stop 140 creating a bias tending to return the valve spool 108 to the center position.

Looking now to FIGS. 5, 7, 16 and 17, the details of the digital feed mechanism will be described.

Figure 17:
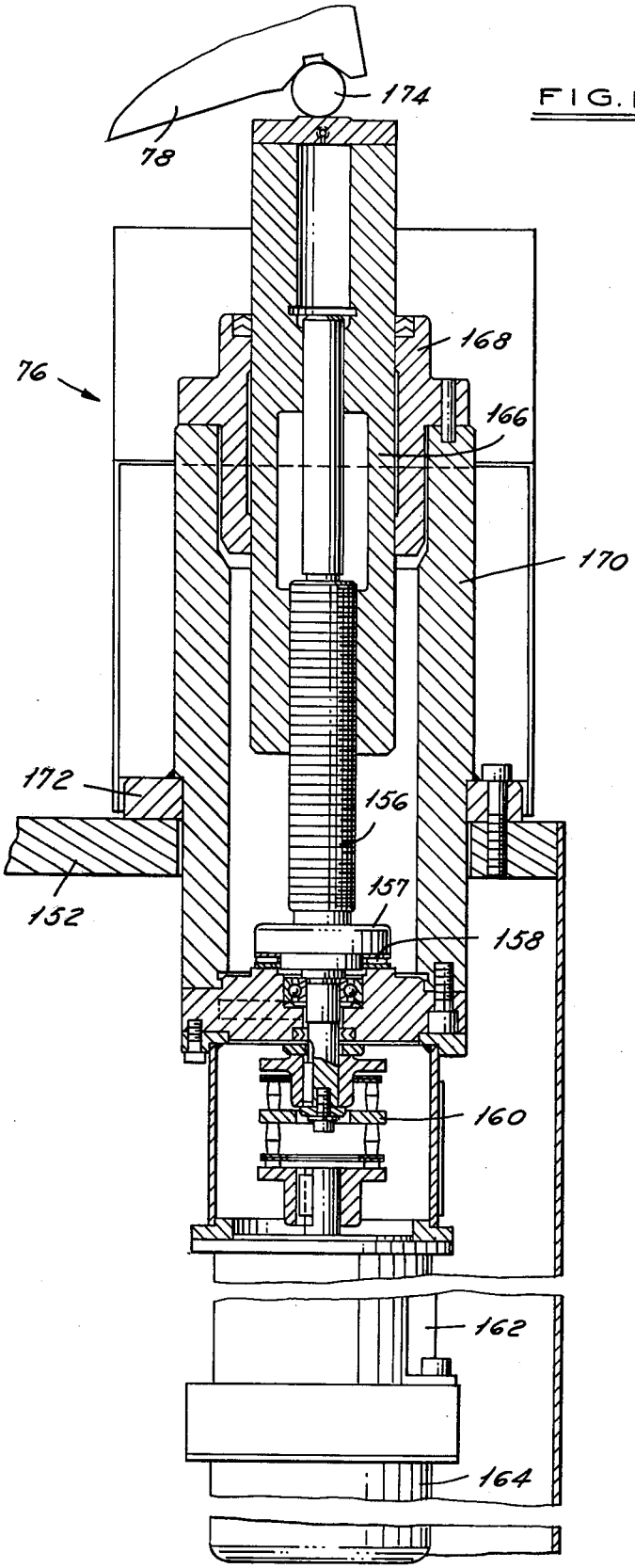
FIG. 17 is a sectional view of the lateral feedcase showing the feedscrew details.

FIG. 5 shows the base 10 to comprise a support surface 152 having an aperture 154 machined therein to receive the feedcase 76 best shown in FIG. 17. Feedcase 76 comprises a suitable housing containing a feed screw 156 having a threaded portion terminating at the lower end in a collar 157 which rests on a thrust bearing 158. Feed screw 156 is connected through coupling 160 to a dc pulse motor 162 which turns the shaft of feed screw 156 in a direction and to a degree determined by a feed end point input system. Such a digital feed in-point input system forms no part of the present invention but may be of the type disclosed in copending application for U.S. Pat. Ser. No. 465,333, filed Apr. 29, 1975, in the name of Roger L. Schroeder. Feed screw 156 is connected through motor 162 to a resolver 164 which generates a position feedback signal as will be apparent to those skilled in the feedback systems art. A non-rotatable mechanically trapped nut 166 is threaded onto feed screw 156 so as to be displaced vertically up and down within the confines of a self-lubricated bearing member 168 which is pinned to the cylindrical case 170 of the feedcase assembly 76. Case 170 is welded to mounting ring 172 which in turn rests on and is secured to the mounting surface plate 152 of the machine base 10.

The upper end of feed nut 166 is in contact with a roll 174 which in turn is craddled within a notched portion of feed lever 78 so as to transmit the vertical position quantity to the feed contact piston 82 as previously described. Roll 74 is mechanically connected to the lever 78 and merely rests on the end of the feed nut 166.

Figure 16:
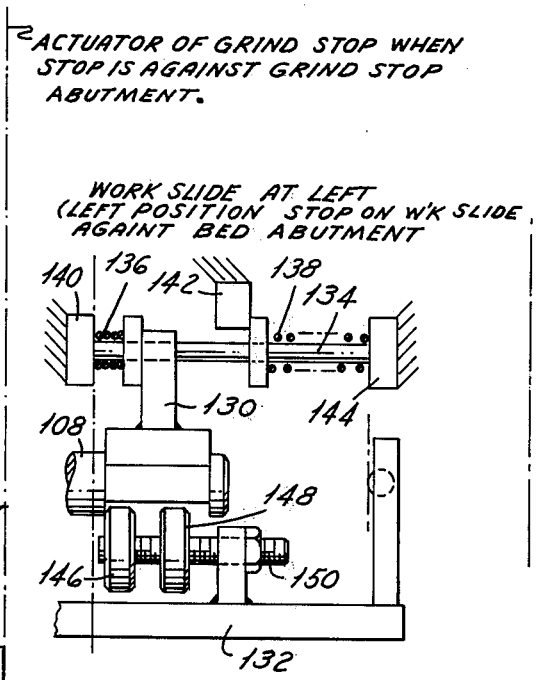
Figure 18:
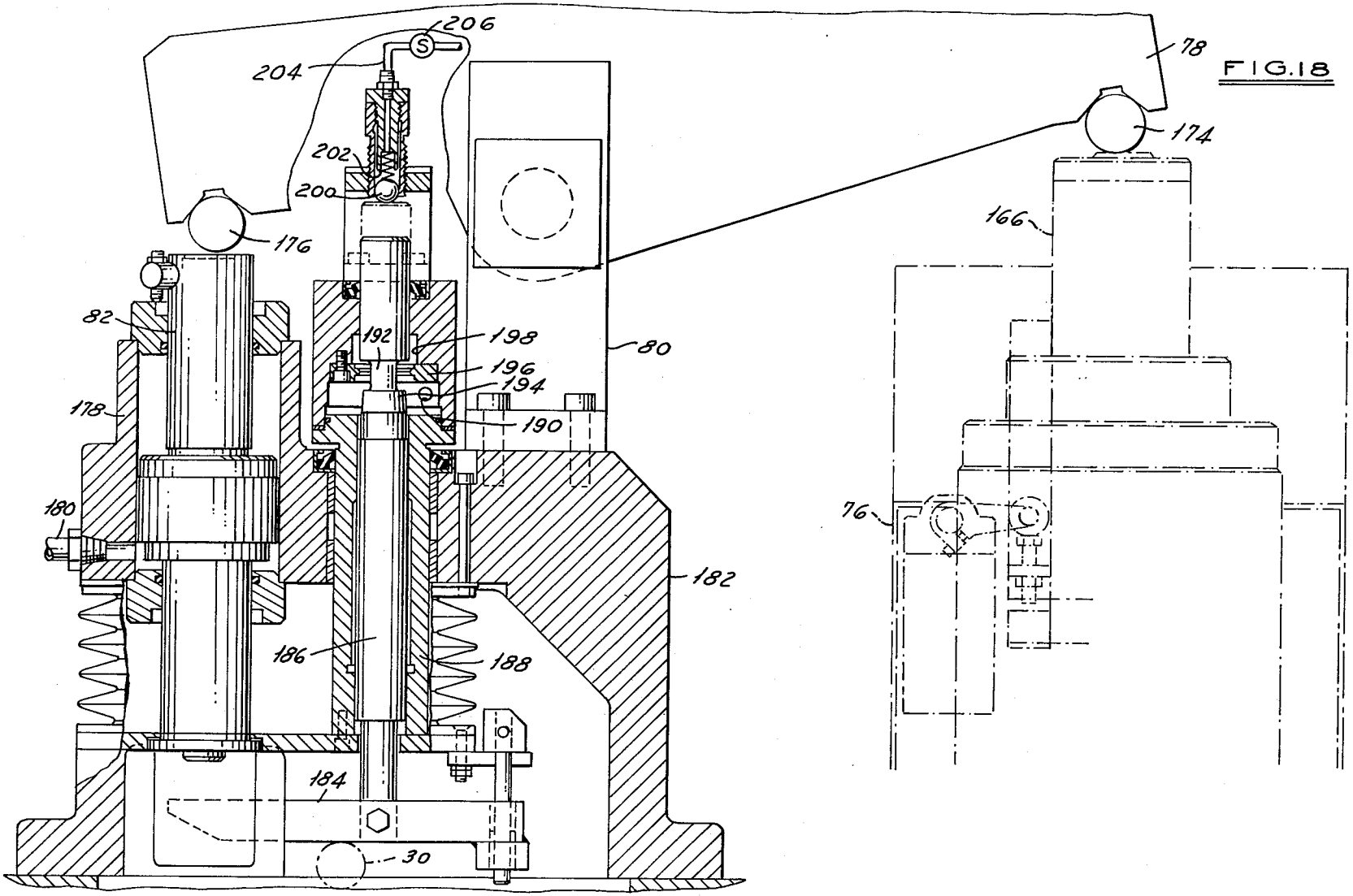
FIG. 18 is a sectional view of the feed contact piston.

Looking to FIG. 18, feed contact piston 82 is slidably disposed with a cylinder housing 178 having an inlet port 180 adapted to be connected to a high pressure air source so as to preload the contact piston 82 upwardly against a contact roll 176 which is carried on the left end of lever 78 as shown in FIG. 16. In addition, the feed contact piston assembly comprises a deceleration valve mechanism 182 to decelerate the effective feed process at the end of a jump move to the grind position such that the workslide tail roll 86 operatively engages the feed contact piston 82 and roll 86A contacts a ski 184 which is mounted on the end of a valve spool 186 slidably disposed within a valve cylinder 188 so as to regulate the flow of oil to the feed cylinder 62 as hereinafter described. Spool 186 in cylinder 188 is provided with a necked-down portion 192 adjacent a tapered portion 194 both of which are slidably disposed through and coaxial with an orifice plate 196. The combination of spool 186 and orifice plate 196 regulate the flow of oil from an inlet port 190 to an outlet chamber 198 which is in the supply path from a high pressure oil source to a feed cylinder 62 previously described. In operation, the roll 86A on the workslide tail 26 contacts the ski 184 lifting the spool 186 and reducing the oil flow to the feed cylinder 62 just before the ski 184 contacts the end of the feed contact piston 82.

The jump move previously described is normally carried out to bring the workslide to the "absolute zero" position wherein the centerline of the work is coaxial with the centerline of the wheelhead 40 and all clearances between the two tails 26 and 60 have been taken up as well as the clearance between roll 86 and feed contact piston 82. At this point, the spool 186 is lifted by roll 86A sufficient to seat a ball 200 against seat 202 trapping air from a pressure source in line 204 and closing a pressure responsive switch 206 which signals the feed motor to begin to feed the work into the grinding wheel 54 for the actual grind process.

Figure 19:
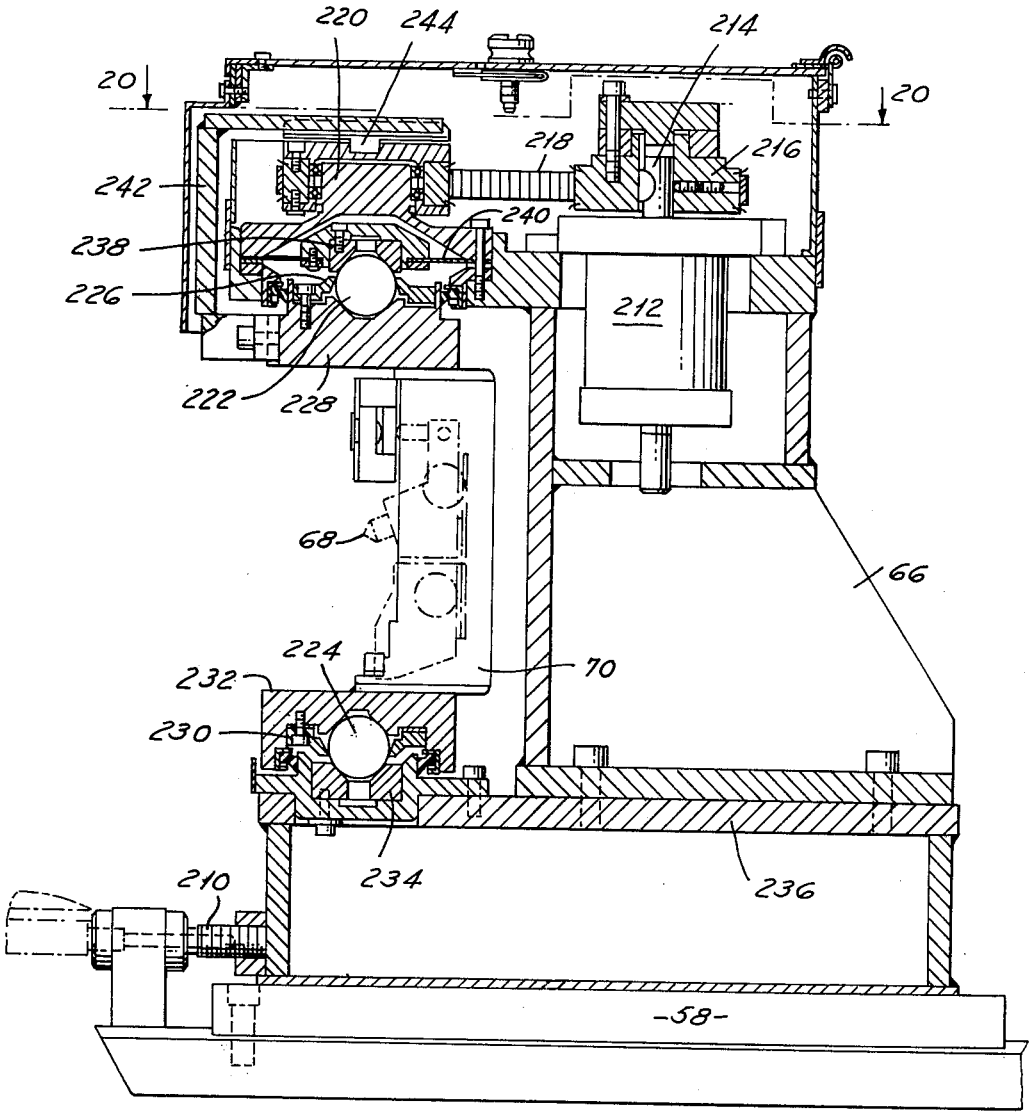
FIG. 19 is a sectional view of the dresser assembly.
Figure 20:
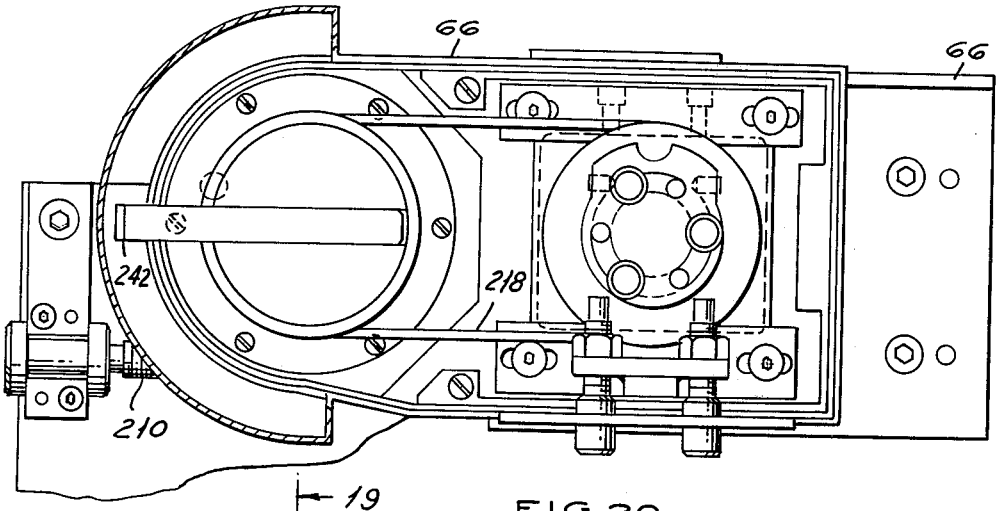
FIG. 20 is a top view of the dresser housing.
Figure 21:
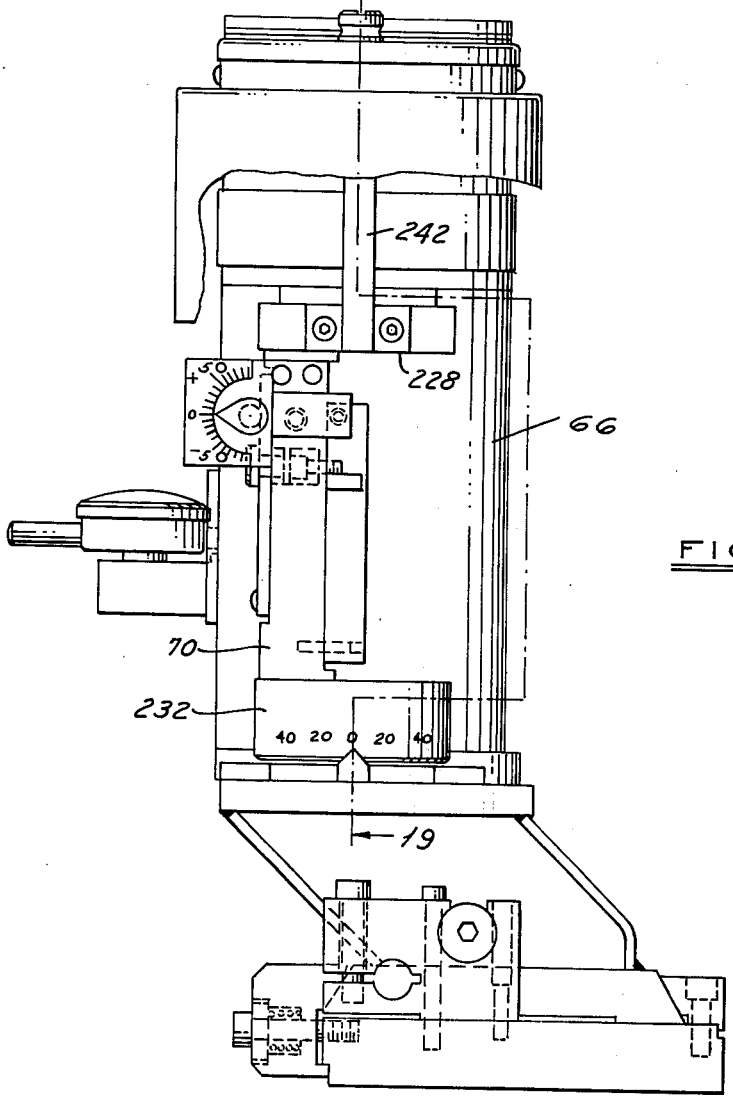
FIG. 21 is a front view of the dresser housing.

Referring to FIGS. 18, 19 and 20, the details of the dresser housing and its components will be described. The dresser housing 66 is mounted on dresser base 58 and secured by adjustable screw mechanism 210 to permit it to be moved radially of the wheelhead to accommodate grinding wheels of different sizes. Diamond 68 is mounted in a rotatable holder 70 as previously described to permit the diamond 68 to be rotated through approximately 120° to contact substantially the entire working periphery of the grinding wheel 54 during the dress step. To accomplish this a reversible hydraulic rotary cylinder 212 is mounted within the assembly 66 and has an output shaft 214 connected to a pulley 216. A flexible drive belt 218 is wound around the pulley 216 and extends to and around a second pulley 220 which is fixed to a mechanical ground to provide a pure torque to the holder 70, free of any bending moments generated by tension in the belt 218 and operation of the hydraulic cylinder 212.

To this end, holder 70 is mounted top and bottom in ball bearings 222 and 224. Ball clamp 226 secures the ball to the upper seat 228 and similarly ball clamp 230 secures the lower ball 224 to the lower seat 232. A second lower ball seat 234 is secured to the dresser housing base 236 which rests on a dresser base 58 as shown. An upper seat is connected to the pulley 220 by means of a steel diaphragm spring 240, the outer periphery of which is clamped through to housing 66. Pulley 220 is connected to the holder 70 by means of a torque link 242 and an Oldham coupling 244 comprising two orthogonal sliding keys to prevent the transmission of the bending moment to the torque link and thence to the holder 70.

Figure 8:
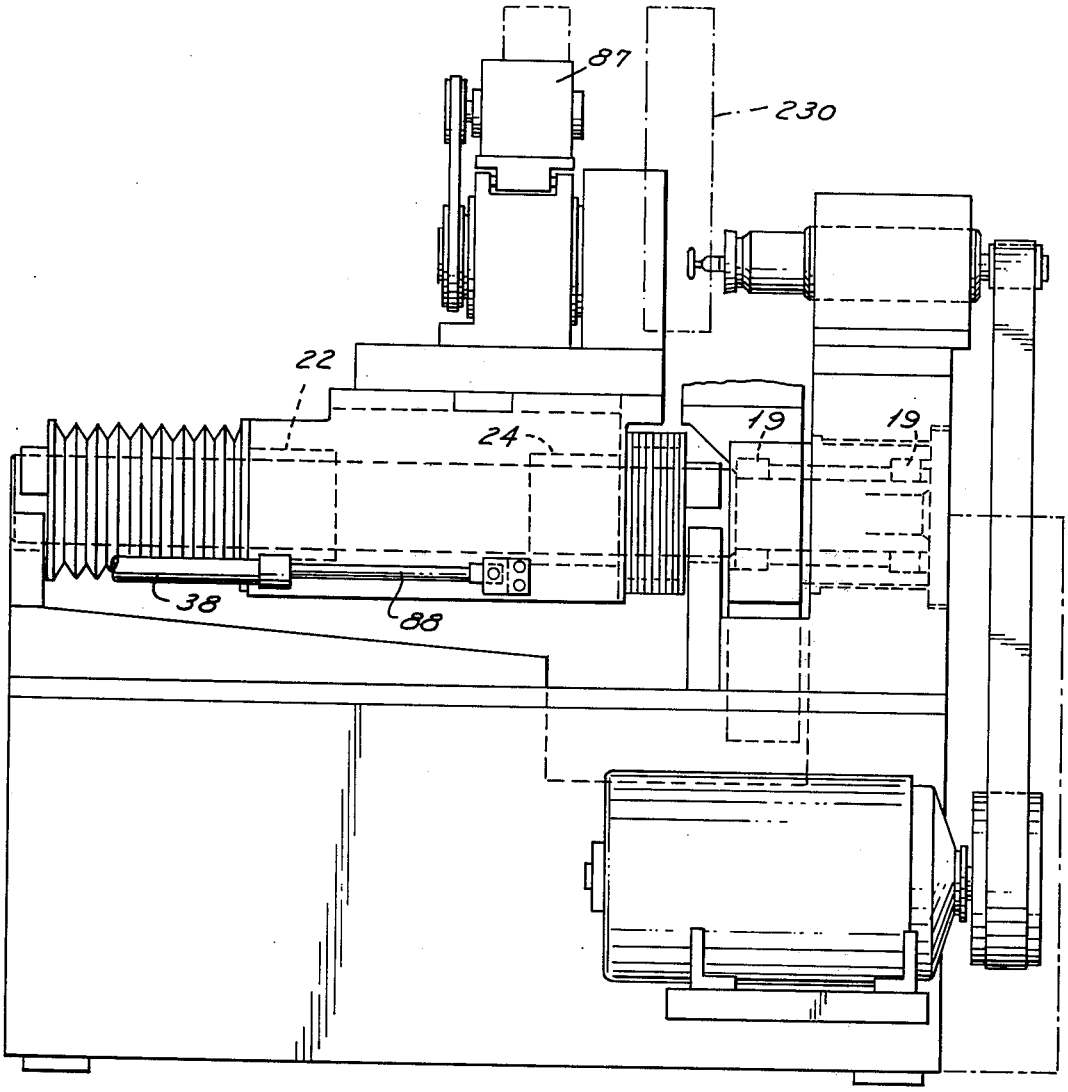
FIG. 8 is a front view indicating the configuration of the wheelhead drive system as well as the longitudinal workslide drive.
Figure 22:
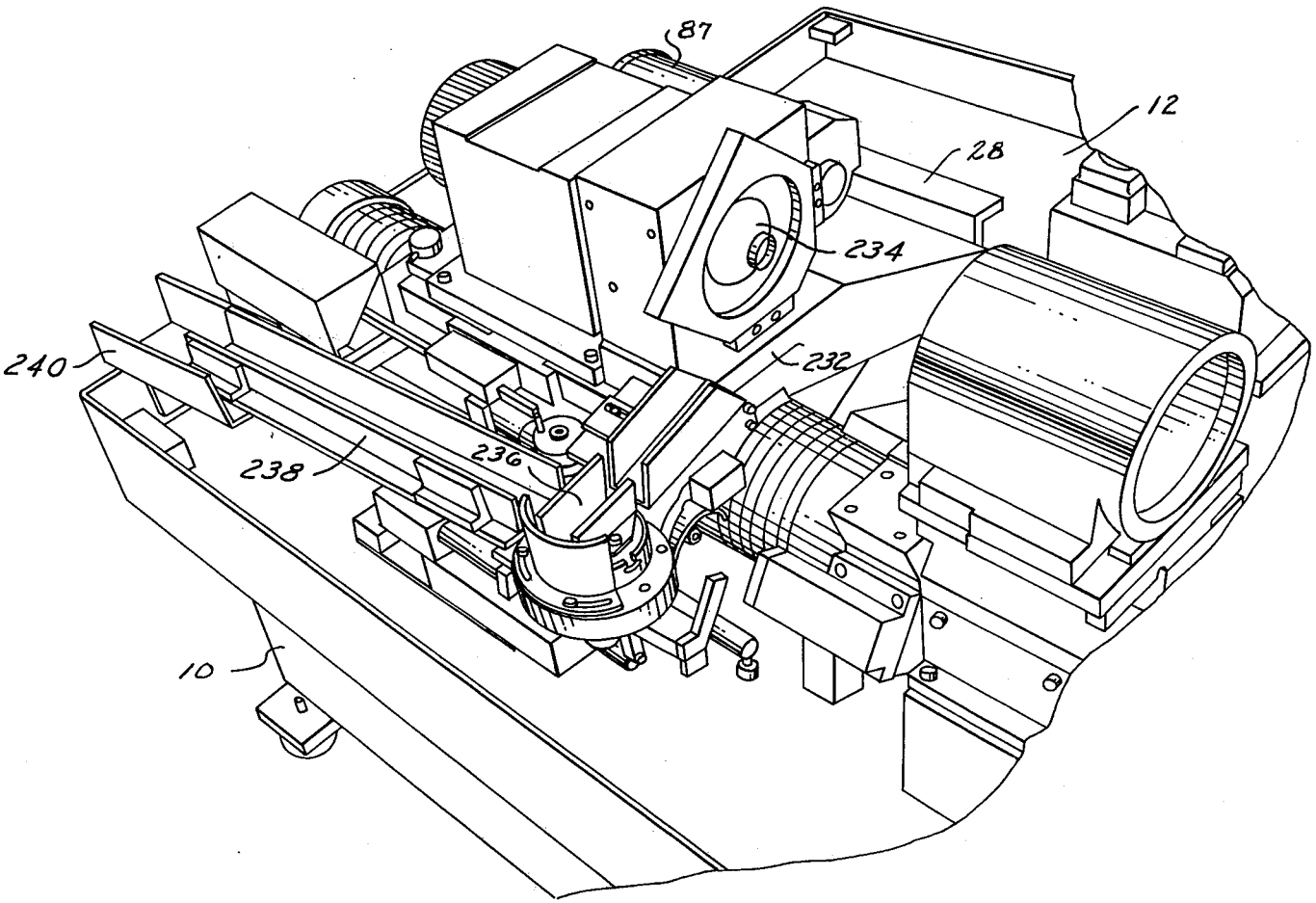
FIG. 22 is a perspective view of the workhead and the unload mechanism.

Referring to FIGS. 8 and 22, a description of a load mechanism and an unload mechanism suitable for use in connection with the subject invention will be made. The load mechanism is generally indicated at 230 in FIG. 8 to indicate a magazine type device capable of carrying three or four workpieces in substantially fixed relationship with the workslide 20. Workpieces are preferably fed into the magazine 230 by a vibrating tray such as the device available from the Dyna Slide Division of Lipe Rollway of East Syracuse, New York. An escapement mechanism can be provided to drop the workpieces into the magazine 230 one at a time where they are transferred to the workhead for securement in a state of the art chuck. A magnetic chuck has been found most suitable for use with an application of the subject invention to the internal grinding of bearing races.

FIG. 22 shows the unload mechanism to comprise a chute 232 disposed immediately below the magnetic chuck 234 to receive the workpieces and carry them downwardly to a turn table 236. Each part is then turned 90° and dropped into a second longitudinally extending chute 238 which longitudinally overlaps an exit chute 240 mounted on the machine base 10. Except for the final chute 240, all of the other chute components including portions 232 and 238 and turn table 236 are mounted on the workslide 20 for displacement therewith. Turn table 236 may be operated by means of an air cylinder of solenoid as will be apparent to those skilled in the art.

It is to be understood that the invention has been described by reference to a very specific implementation thereof and that various modifications of the illustrative embodiment may be made and will be apparent to those skilled in the art.

The embodiments of the invention in which an exclusive property or privilege is claimed are defined as follows:

1. A grinding machine comprising a base, a slidebar mounted on the base, a wheelhead fixed on the base over the bar, a dresser base pivotally mounted on the bar for rotation thereabout, power means for rotating the dresser base about the bar, a dresser housing for receiving a dresser implement mounted on the dresser base on one side of the wheelhead and a gagehead mounted on the dresser base on the other side of the wheelhead whereby pivotal rotation of the dresser base about the bar in one direction causes the gagehead to be displaced toward the wheelhead and rotation of the dresser base about the bar in the opposite direction causes the dresser housing to be advanced toward the wheelhead.

* * * * *